United States Patent [19]

Racca

[11] Patent Number: 4,543,746

[45] Date of Patent: Oct. 1, 1985

[54] SLIDING DOUBLE DOORS, PARTICULARLY FOR RAILWAY AND TRAMWAY VEHICLES

[75] Inventor: Carlo Racca, Turin, Italy

[73] Assignee: Fiat Ferroviaria Savigliano S.p.A., Italy

[21] Appl. No.: 608,186

[22] Filed: May 8, 1984

[30] Foreign Application Priority Data

Jun. 28, 1983 [IT] Italy ..... 67704 A/83

[51] Int. Cl.[4] ..... E05F 17/00

[52] U.S. Cl. ..... 49/118; 49/123; 49/218

[58] Field of Search ..... 49/118, 123, 116, 209, 49/210, 211, 216, 218, 219, 220

[56] References Cited

U.S. PATENT DOCUMENTS 1,916,480 7/1933 Jacobson ..... 49/118 X 3,994,094 11/1976 Marzocco ..... 49/218 X 4,091,570 5/1978 Favrel ..... 49/118

*Primary Examiner*—Philip C. Kannan

*Attorney, Agent, or Firm*—Robbins & Laramie

[57] ABSTRACT

Sliding doors, particularly for railway and tramway vehicles, comprise two opposing doors which are movable relative to a doorway between an emplaced closed position and a withdrawn open position by guide means and motorized drive means. The drive means include a motorized chain transmission connected to the two doors to effect their opening and closing sliding movements, and rotatable cam means defining, for each door, an arcuate track with which feeler means connected to the two doors cooperate to effect, in the initial phase of the opening sliding movement and in the final phase of the closing sliding movement of these doors respectively, the withdrawal and the emplacement of the doors relative to the doorway.

4 Claims, 6 Drawing Figures

SLIDING DOUBLE DOORS, PARTICULARLY FOR RAILWAY AND TRAMWAY VEHICLES

The present invention relates generally to sliding doors, particularly for railway and tramway vehicles.

More particularly, the invention relates to doors of the type comprising two opposing doors movable relative to a doorway between a closed position in which the doors are close together and emplaced in the doorway, and an open position in which the doors are withdrawn from the doorway and spaced from each other, guide means for guiding the doors in their opening and closing movements, and motorised drive means for effecting the opening and closing movements.

The object of the present invention is to provide doors of the type specified above in which the guide means have a rectilinear configuration which is simple to manufacture, and in which the motorisation of the drive means is achieved relatively economically.

According to the invention this object is achieved by virtue of the fact that the drive means include a motorised chain transmission connected by respective actuators to the two doors and movable in one direction or in the opposite direction respectively to effect the opening and closing sliding movements, and rotatable cam means defining, for each door, an arcuate track having an initial portion in the form of an arc of a spiral and a final portion in the form of an arc of a circle and with which feeler means connected to the two doors cooperate to effect, in the initial phase of opening sliding movement and in the final phase of closing sliding movement of the two doors respectively, the withdrawal and emplacement of the doors relative to the doorway.

According to the invention, the chain is driven by means of a single pressurised-fluid jack having one end connected directly to the chain itself.

Figure 1:
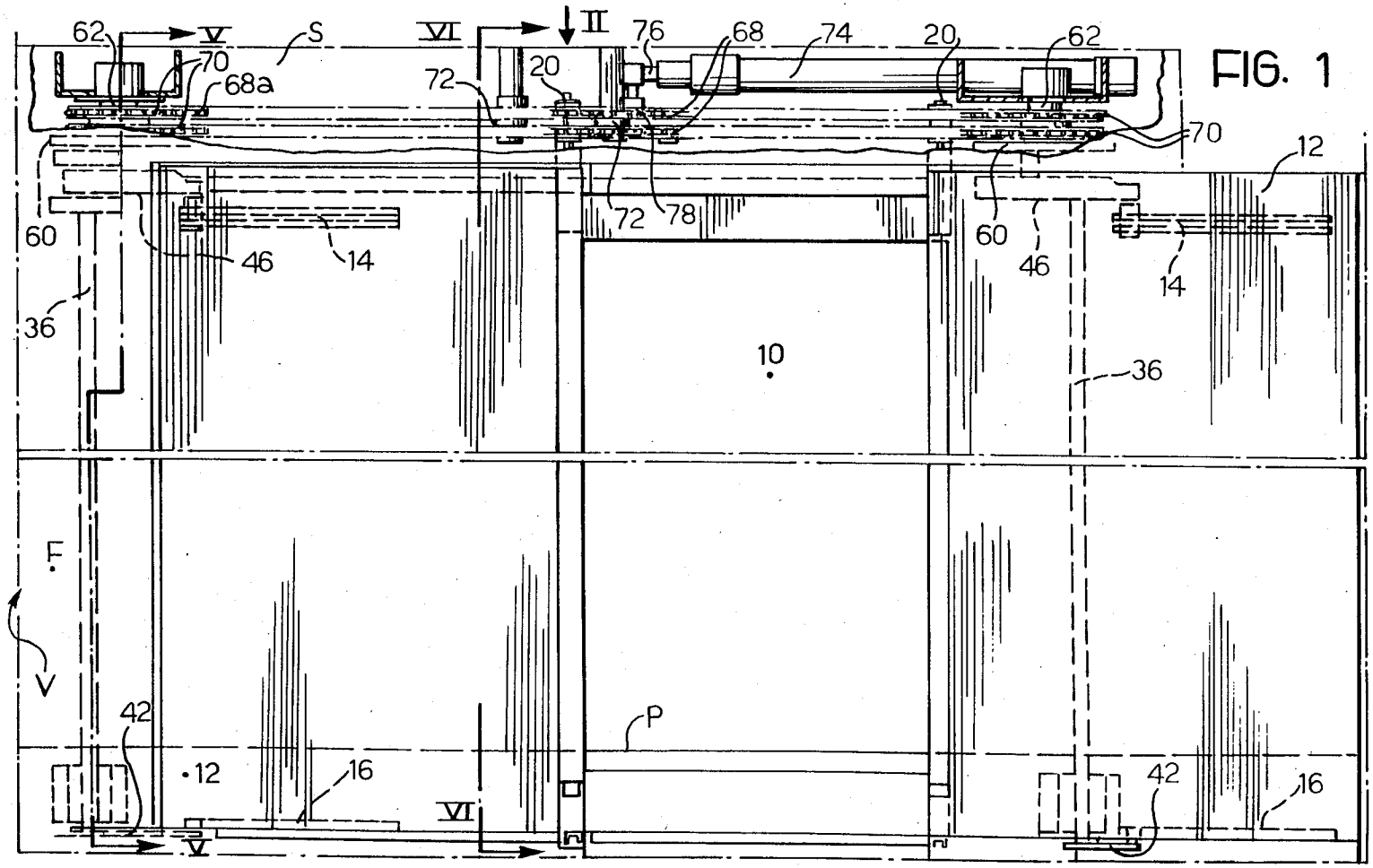
Figure 2:
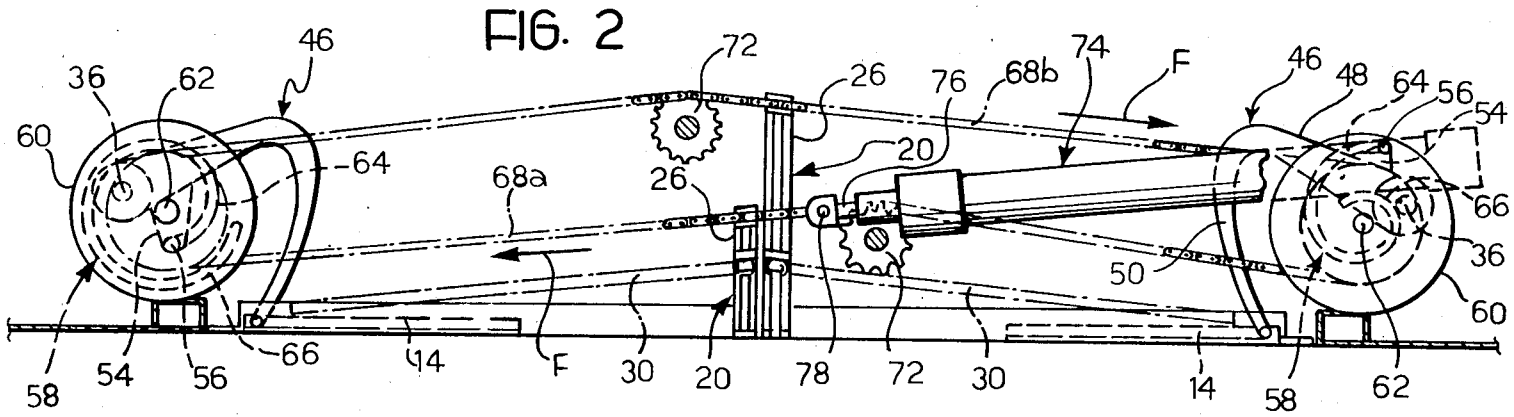
Figure 3:
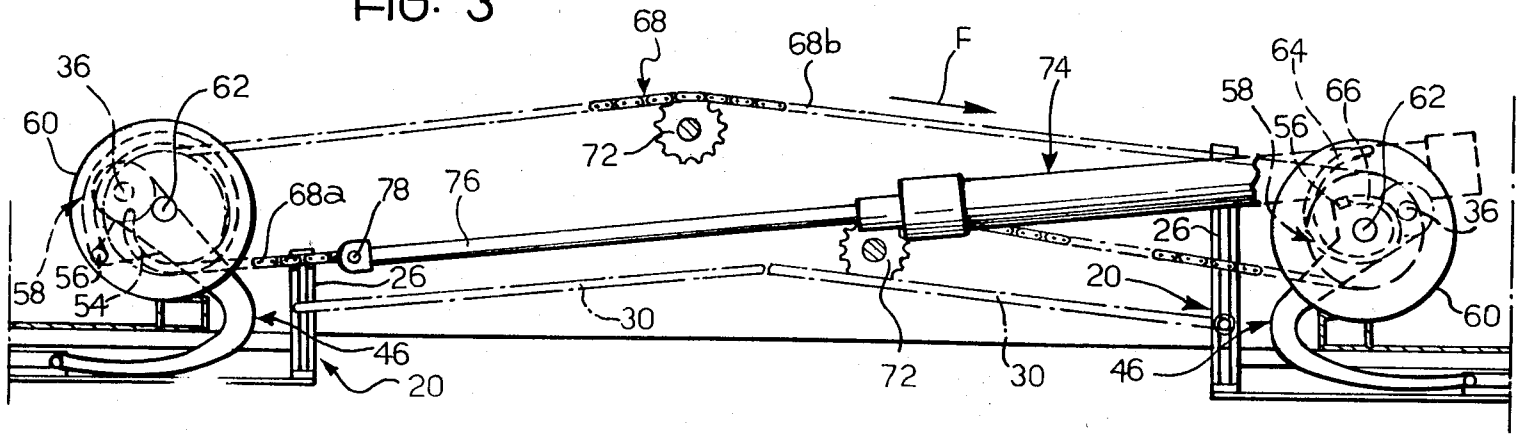
Figure 4:
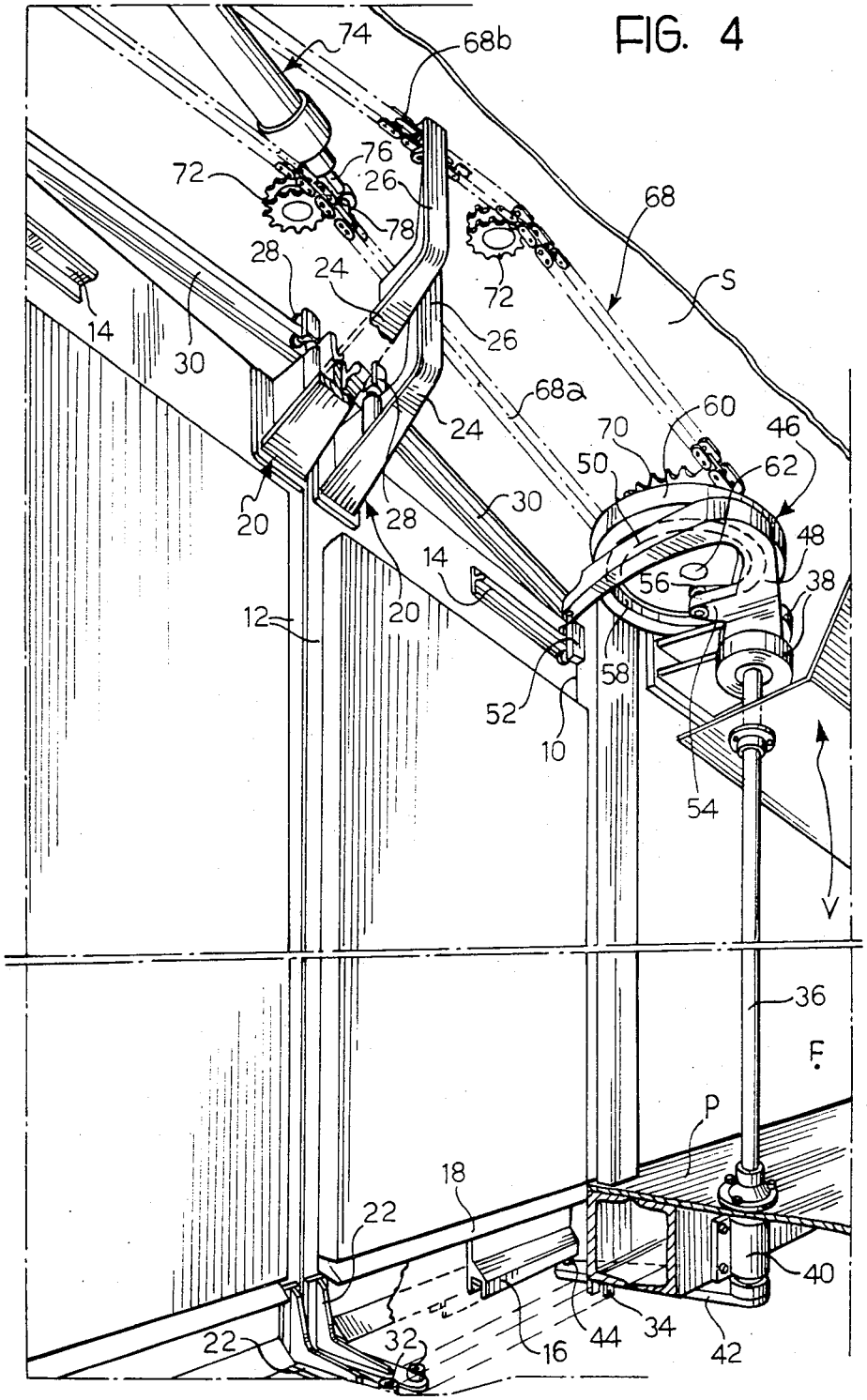
Figure 5:
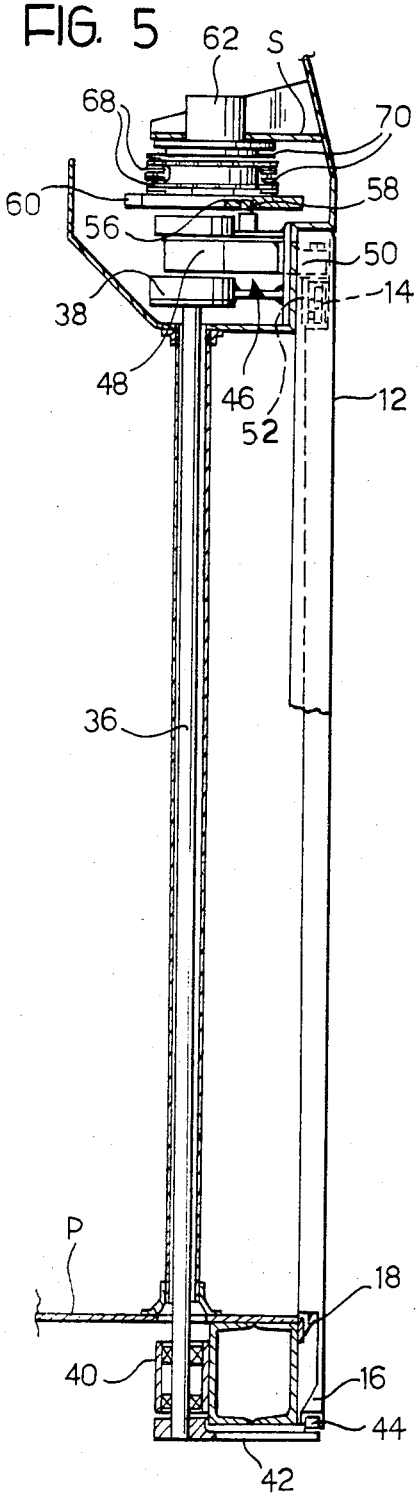
Figure 6:
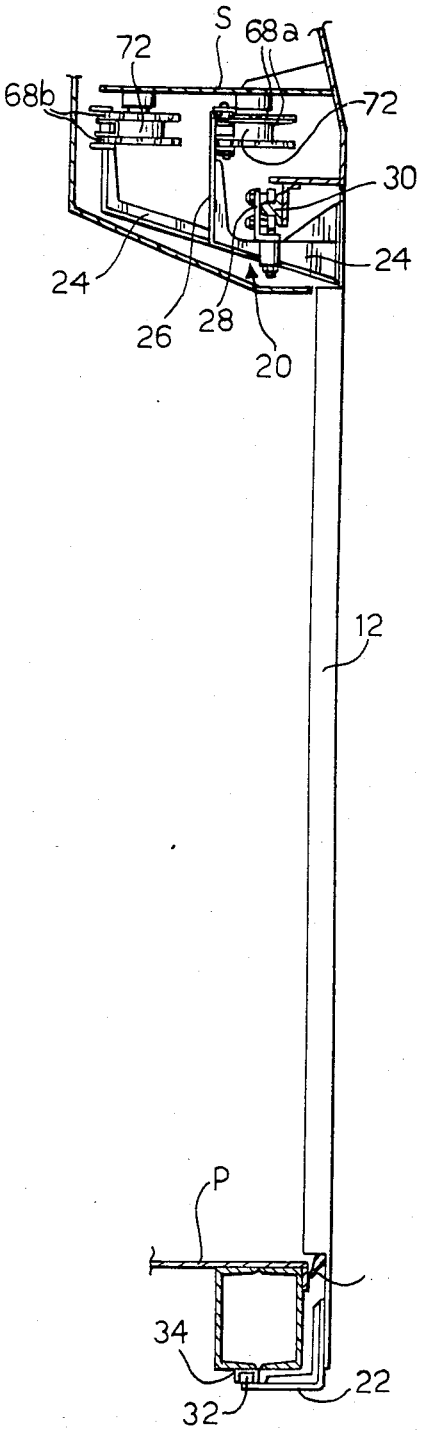

The invention will now be described in detail with reference to the appended drawings, provided purely by way of non-limiting example, in which:

FIG. 1 is a schematic, partially-sectioned front elevational view of part of a railway or tramway vehicle with double sliding doors according to the invention, showing one door in the open position and the other door in the closed position, FIG. 2 is a vertical sectional view taken on arrow II of FIG. 1 with the two doors in the closed position, FIG. 3 is a view similar to FIG. 2 with the two doors in the open position, FIG. 4 is a partially cut-away perspective view of the doors seen from inside the vehicle, FIG. 5 is a vertical sectional view taken on the line V—V of FIG. 1, and FIG. 6 is a vertical sectional view taken on the line VI—VI of FIG. 1.

In the drawings, part of a railway or tramway vehicle is indicated V and has a floor P, an upper wall S and a side F in which an aperture 10 constituting a doorway is formed.

Two opposing doors 12 are movable simultaneously relative to the doorway 10 between a closed position illustrated in FIGS. 2 and 4 and the left-hand part of FIG. 1, in which they are close together and emplaced in the doorway 10, and an open position illustrated in FIG. 3 and in the right-hand part of FIG. 1, in which they are withdrawn from the doorway 10 and spaced from each other, being located parallel to the portions of the side F adjacent the sides of the doorway 10.

Each door 12 is constituted by a rectangular panel to the inner face of which is fixed, starting from the outer edge adjacent the upper edge, a profiled guide 14.

Along the lower edge of each panel 12 is a channel-section guide 16 surmounted by a sealing lip 18 disposed in sealing contact with the facing edge of the floor P of the vehicle V.

Close to the inner edge of each panel 12 are fixed an upper arm 20 and a lower cranked arm 22 projecting inwardly of the vehicle V respectively beneath the upper wall S and beneath the floor P. Each upper arm 20 has a substantially horizontal part 24 and a substantially vertical part 26 which projects upwardly; as is clearly seen in FIGS. 2 and 3, the length of the part 24 of the arm 20 associated with the right-hand door 12 is greater than the part 24 of the arm 20 associated with the left-hand door 12, for reasons which will be explained below.

The parts 24 of the two upper arms 20 carry respective roller guide members 28 which engage a pair of upper guides 30 carried by the upper wall S and angled outwardly towards the side edges of the doorway 10.

The free ends of the two lower arms 22 carry respective roller guide members 32 inserted in corresponding lower guides 34 attached beneath the floor B and located parallel to the upper guides 30.

Two vertical shafts 36 are located adjacent the side edges of the doorway 10 and are rotatable in respective bushes 38, 40 supported by the upper wall S and the floor P of the vehicle V.

A horizontal, outwardly-projecting arm 42 is fixed at the lower end of each shaft 36 and carries at its free end a roller guide member 44 which engages the lower guide 16 of the respective door 12.

The top of each shaft 36 carries an arm 46 which is generally bent into essentially a V-shape; the arms are disposed as mirror images relative to the middle of the doorway 10. Each arm 46 has, in fact, a portion 48 fixed to the shaft 36 and a portion 50 bent relative to the portion 48 and carrying a guide carriage 52 at its free end, which engages the upper guide 14 of the respective door 12.

The portions 48 of the two arms 46 have projections 54 carrying two feeler rollers 56 which engage respective arcuate guide tracks 58 formed in a pair of wheels 60 rotatable about vertical pins 62 carried by the upper wall S close to the tops of the shafts 36.

As is clearly seen in FIGS. 2 and 3, the arcuate tracks 58 have similar configurations defined by an initial portion 64 in the form of an arc of a spiral and a final portion 66 in the form of an arc of a circle. In the track 58 of the wheel 60 associated with the right-hand door, the portion 64 in the form of an arc of a spiral is disposed towards the exterior, that is, close to the periphery of the wheel 60, while the track 58 of the wheel 60 associated with the left-hand door has its portion 64 in the form of an arc of a spiral situated more towards the interior, that is, towards the centre of the wheel 60.

In the closed position of the two doors 12, the wheels 60, with their tracks 58 and the arms 46, are located in the position illustrated in FIG. 2 with the feeler rollers 56 disposed in correspondence with the initial ends of the spiral arcuate portions 64 of the two tracks 58.

The rotation of the two wheels 60 is achieved by means of an endless chain transmission 68 (in the example illustrated there are two) which passes over respective gear wheels 70, with elongate teeth, coaxial with the wheels 60. The chains 68 also run on two idle sprockets 72 so as to take up the configuration illustrated in FIGS. 2 to 4, in which they have a left-hand portion 68*a* parallel to the angled guides 30, 34 associated with the left-hand door 12, and an opposite right-hand portion 68*b* parallel to the guides 30, 34 associated with the right-hand door 12. The free end of the vertical portion 26 of the upper arm 20 fixed to the left-hand door 12 is fixed to the portion 68*a*, while the free end of the vertical portion 26 of the arm 20 fixed to the right-hand door 12 is fixed to the portion 68*b*.

The movement of the chains 68 is effected by means of a single pressurised-fluid jack 74 supported by the upper wall S of the vehicle, the rod 76 of which is fixed at 78 to the initial ends of the portions 68*a* of these chains.

In the closed position of the two doors 12, the jack 74 is in the contracted condition illustrated in FIGS. 2 and 4.

In order to effect the opening of the doors 12, the jack 74 is extended by means of a conventional pressurised-fluid circuit, not illustrated, so as to move the portions 68*a* and 68*b* of the chains 68 in the direction indicated by the arrows F.

The movement of the chains 68 causes simultaneously the movement of the upper arms 20 of the two panels 12 in opposite directions and the clockwise rotation of the two wheels 60. The two panels 12 then start to move away from each other while, simultaneously, the two arms 46 move angularly with their respective vertical shafts 36 as a result of the cooperation between the feeler rollers 56 and the arcuate tracks 58. During the first phase of this displacement, the feeler rollers 56 pass over the initial spiral arcuate portions 64, whereby the panels 12 are displaced angularly outwardly of the doorway 10 due to the cooperation between the guide carriages 52 carried by the arms 46 and the upper guides 14 as the panels 12 proceed in their sliding movements away from each other along the guides 30 and 34. The lower parts of the panels 12 are accompanied by the arms 42 driven by the vertical shafts 36 and cooperating with the lower guide 16.

At the end of this withdrawal phase of the doors 12, the feeler rollers 56 pass over the final circular arcuate portions 66 of the two tracks 58 and the arms 46 then accompany the sliding of the panels 12 during the phase of the full extension of the jack 74 to the open position illustrated in FIG. 3.

Clearly, the closure of the two doors with their re-emplacement in the doorway 10 is achieved by contracting the jack 74.

Naturally, the principle of the invention remaining the same, the constructional details and the embodiments may be varied widely with respect to that described and illustrate, without thereby departing from the scope of the present invention.

What is claimed is:

1. Sliding doors, particularly but not exclusively for railway and tramway vehicles, of the type comprising means defining a doorway; two opposing doors movable relative to the doorway between a closed position in which the doors are emplaced in the doorway and closed together and an open position in which the doors are withdrawn from the doorway and spaced from each other; guide means for guiding the doors in their opening and closing movements, and motorised drive means for effecting these opening and closing movements, wherein the improvement consists in the drive means including:

a motorised chain transmission connected to the two doors and movable in one direction and in the opposite direction respectively to effect the simultaneous opening and closing sliding movements of the doors;

respective members connecting the chain transmission to the two doors;

respective rotatable cam means defining an arcuate track for each door, each track having an initial portion in the form of an arc of a spiral and a final portion in the form of an arc of a circle, and respective feeler means connected to the doors and cooperating with the respective arcuate tracks to effect, in the initial phase of opening sliding movement and in the final phase of closing sliding movement of the two doors respectively, the withdrawal and emplacement of the doors relative to said doorway.

2. Sliding doors are defined in claim 1, wherein said guide means for each door include:

upper and lower movable horizontal guides fixed to the door close to its upper side and along its lower side respectively;

upper and lower fixed horizontal guides located close to the upper side and the lower side of the doorway respectively, and angled towards the exterior in the direction of the side edges of said doorway;

a first upper arm and a first lower arm fixed to the door close to the upper end and close to the lower end of its inner side respectively, and respective roller guide members provided on said first upper arm and said first lower arm for cooperating with said upper and lower fixed guides, and wherein said drive means include:

a vertical shaft adjacent each side edge of said doorway;

a second upper arm and a second lower arm carried by each said shaft;

respective roller guide members provided on said second upper arms and said second lower arms for cooperating with said upper movable guides and said lower movable guides respectively;

a pair of vertical-axis wheels supported by said means defining the doorway close to the tops of said shafts for simultaneous rotation by means of said motorised chain, each said wheel defining a respective said arcuate track;

respective opposing portions of each said chain, which extend parallel to said fixed upper and lower guides of the respective door and are connected to said first upper arm of this door to effect its sliding movement, and respective feeler members carried by said second upper arms of the doors for cooperating with the respective arcuate tracks whereby, in the closed position of the two doors, said feeler members engage said initial spiral arcuate portions of said tracks and, during the door-opening rotation of the two wheels by means of said chain transmission, the feeler members slide initially along said spiral arcuate portions to effect the withdrawal of the doors from said doorway and subsequently along said circular arcuate portions to the tracks to accompany the opening sliding movements of the doors along the respective fixed guides.

3. Sliding doors as defined in claim 1, wherein the drive means further include a pressurised-fluid jack for driving the chain transmission, said jack having one end connected directly to the chain.

4. Sliding doors as defined in claim 2, wherein each said second upper arm has a substantially V shape, one portion of the V carrying the respective said guide member which cooperates with said upper movable guide of the respective door and the other portion of the V being supported by the top of the corresponding vertical shaft and having a projection which carries the feeler member which cooperates with the arcuate track of the respective wheel.

* * * * *